US010392216B2

(12) United States Patent
Imamura et al.

(10) Patent No.: US 10,392,216 B2
(45) Date of Patent: Aug. 27, 2019

(54) WEB TRANSPORTING APPARATUS, WEB TRANSPORTING METHOD, IMAGE FORMING APPARATUS, AND IMAGE FORMING METHOD

(71) Applicant: SEIKO EPSON CORPORATION, Tokyo (JP)

(72) Inventors: Atsushi Imamura, Nagano (JP); Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 271 days.

(21) Appl. No.: 15/512,617

(22) PCT Filed: Oct. 19, 2015

(86) PCT No.: PCT/JP2015/005251
§ 371 (c)(1),
(2) Date: Mar. 20, 2017

(87) PCT Pub. No.: WO2016/063514
PCT Pub. Date: Apr. 28, 2016

(65) Prior Publication Data

US 2017/0240371 A1 Aug. 24, 2017

(30) Foreign Application Priority Data

Oct. 23, 2014 (JP) ..... 2014-216242

(51) Int. Cl.
*B65H 23/14* (2006.01)
*B65H 23/188* (2006.01)

(52) U.S. Cl.
CPC ..... *B65H 23/14* (2013.01); *B65H 23/188* (2013.01); *B65H 2404/143* (2013.01); *B65H 2404/144* (2013.01); *B65H 2408/214* (2013.01); *B65H 2408/215* (2013.01); *B65H 2511/112* (2013.01);
(Continued)

(58) Field of Classification Search
CPC ..... B65H 23/14; B65H 23/188; B65H 2408/215; B65H 2515/322
See application file for complete search history.

(56) References Cited

U.S. PATENT DOCUMENTS 3,996,842 A 12/1976 Ehlich et al.
5,988,907 A * 11/1999 Iso ..... B41J 11/36 400/636

(Continued)

FOREIGN PATENT DOCUMENTS

JP 10-058661 A 3/1998
JP 2007-112532 A 5/2007

(Continued)

*Primary Examiner* — Sang K Kim

(57) ABSTRACT

A web transporting method includes a drive roller (Gd), N (where N is an integer of 1 or greater) driven rollers (Gn) which nip a wound portion of a web between the drive roller and the driven rollers, and a tension application unit which applies a tension Tl to a portion of the web which is one side of the wound portion and applies a tension Th which is higher than the tension Tl to a portion of the web which is opposite the one side of the wound portion, in which an angle θ0, an angle θ(n), a load P(n), a static friction coefficient μ0, and a static friction coefficient μ(n) satisfy a predetermined relational expression (expression 1).

6 Claims, 11 Drawing Sheets

(52) U.S. Cl.
CPC .. *B65H 2515/312* (2013.01); *B65H 2515/322* (2013.01); *B65H 2801/15* (2013.01)

(56) References Cited

U.S. PATENT DOCUMENTS

2011/0240788 A1* 10/2011 Miyamoto ..... B65H 23/038 242/419.5
2014/0285560 A1 9/2014 Oba et al.

FOREIGN PATENT DOCUMENTS

JP 2009-046285 A 3/2009
JP 2012-136342 A 7/2012

* cited by examiner

[Fig. 1]
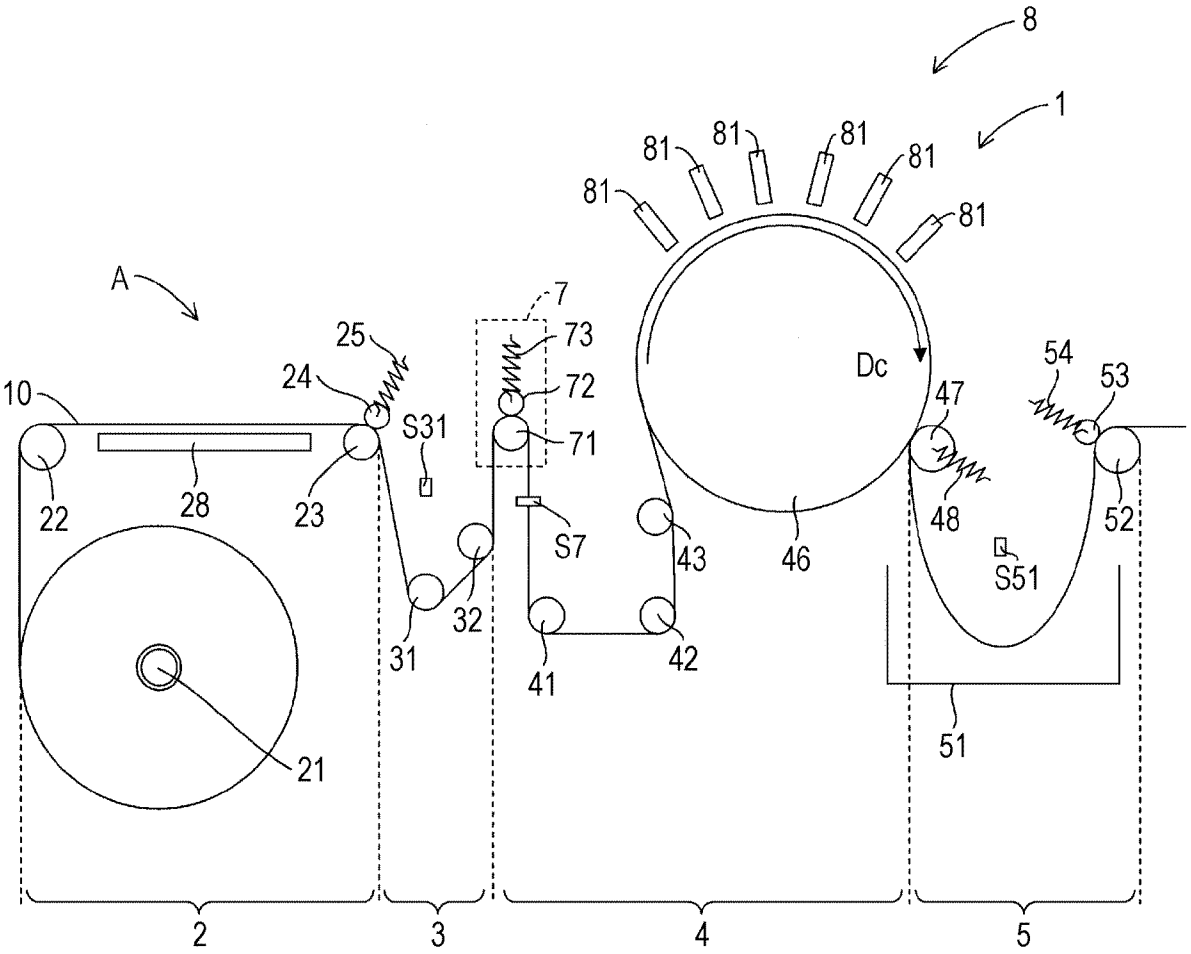

[Fig. 2]
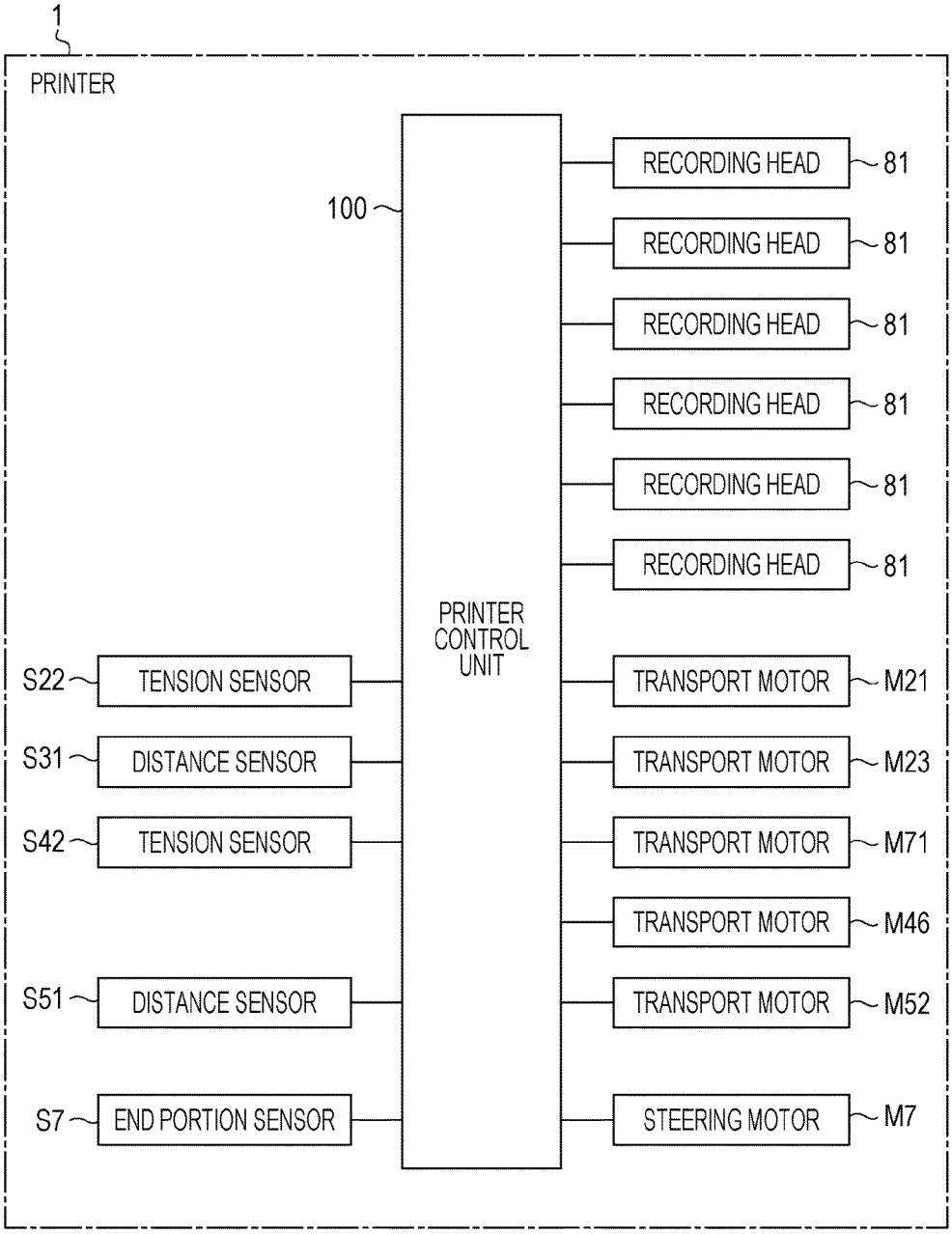

[Fig. 3A]
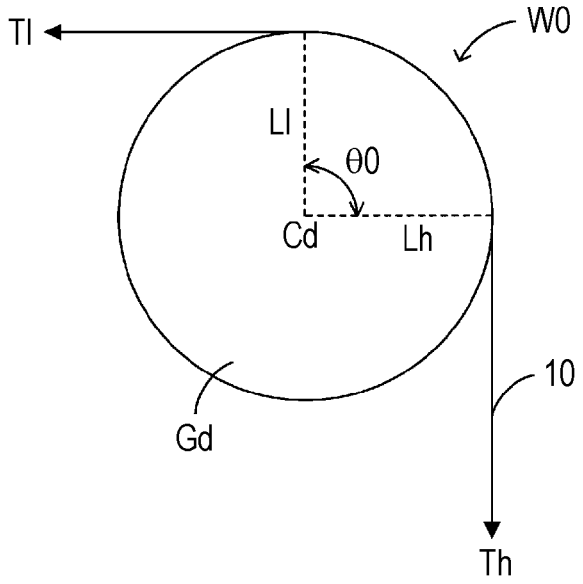
[Fig. 3B]
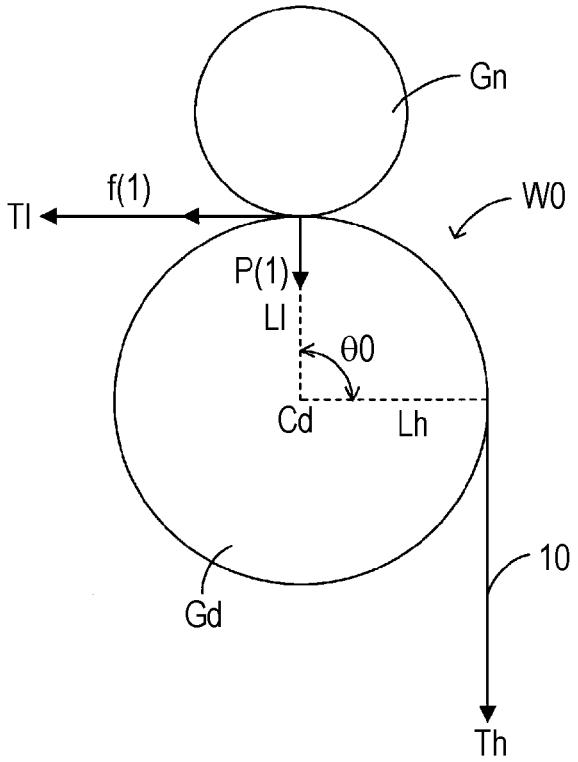

[Fig. 4A]
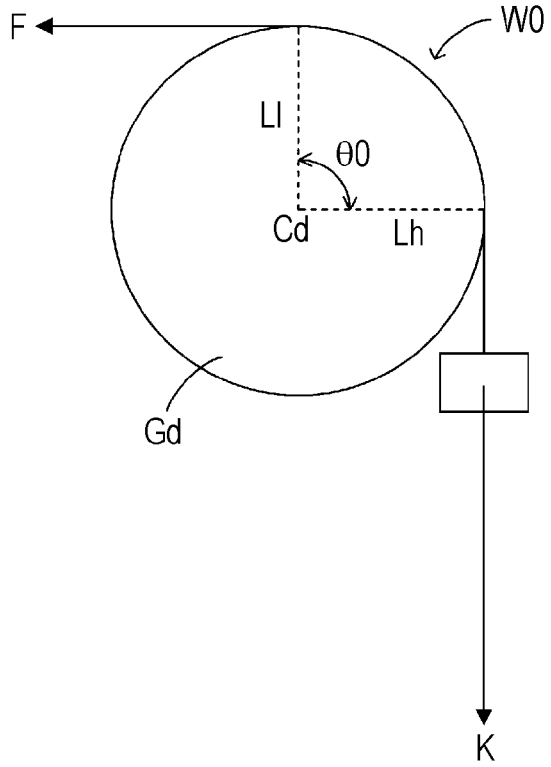
[Fig. 4B]
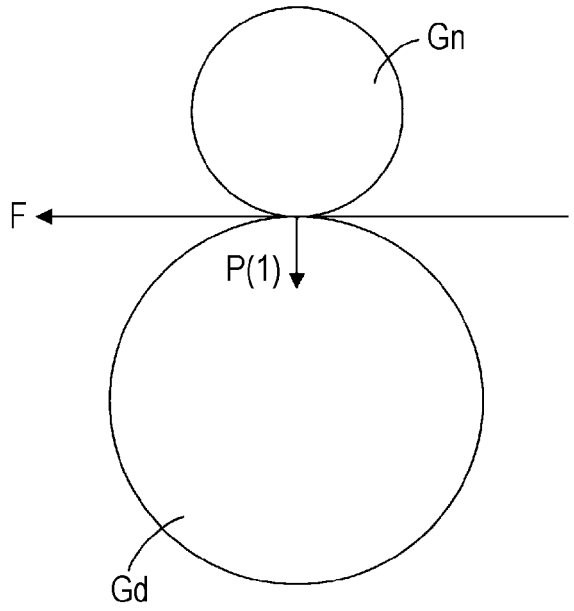

[Fig. 5A]

| | FIRST | SECOND | THIRD | FOURTH | FIFTH | SIXTH | SEVENTH | AVERAGE |
|---|---|---|---|---|---|---|---|---|
| MAXIMUM STATIC FRICTION FORCE F IN N | 2.85 | 2.90 | 2.95 | 2.85 | 2.85 | 2.90 | 2.85 | 2.90 |
| STATIC FRICTION COEFFICIENT μ0 | 0.246 | 0.257 | 0.268 | 0.246 | 0.246 | 0.257 | 0.246 | 0.252 |

[Fig. 5B]

| | FIRST | SECOND | THIRD | FOURTH | FIFTH | SIXTH | SEVENTH | AVERAGE |
|---|---|---|---|---|---|---|---|---|
| MAXIMUM STATIC FRICTION FORCE F IN N | 58.6 | 56.0 | 54.7 | 54.5 | 58.7 | 56.4 | 58.8 | 56.8 |
| STATIC FRICTION COEFFICIENT μ(1) | 0.803 | 0.767 | 0.749 | 0.747 | 0.804 | 0.773 | 0.805 | 0.778 |

[Fig. 6]

| | FIRST | SECOND | THIRD | FOURTH | FIFTH | SIXTH | SEVENTH | AVERAGE |
|---|---|---|---|---|---|---|---|---|
| MAXIMUM STATIC FRICTION FORCE F IN N | 160 | 170 | 165 | 145 | 145 | 155 | 150 | 156 |

[Fig. 7]
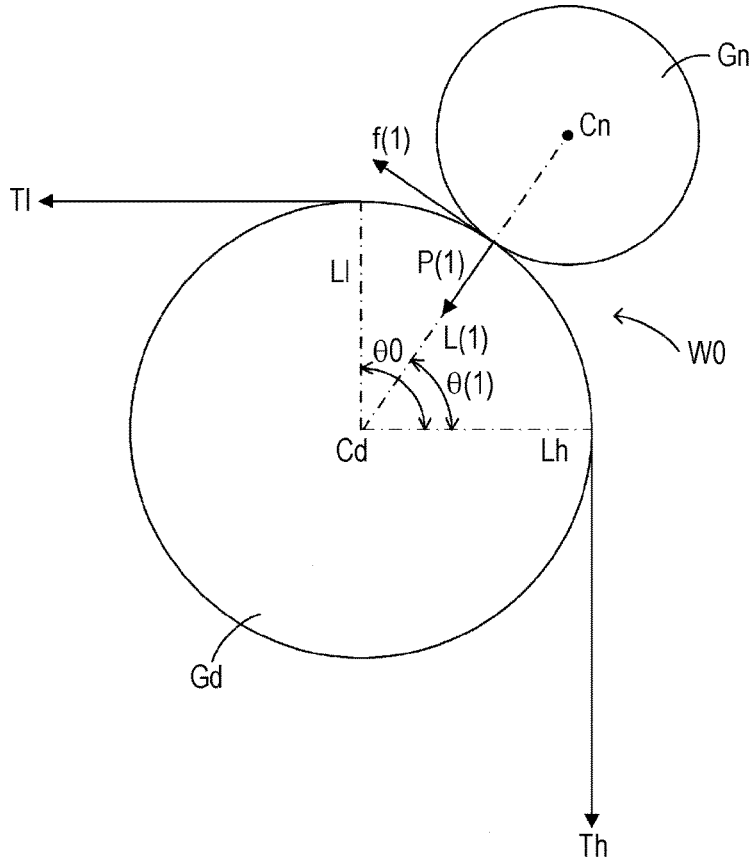

[Fig. 8]
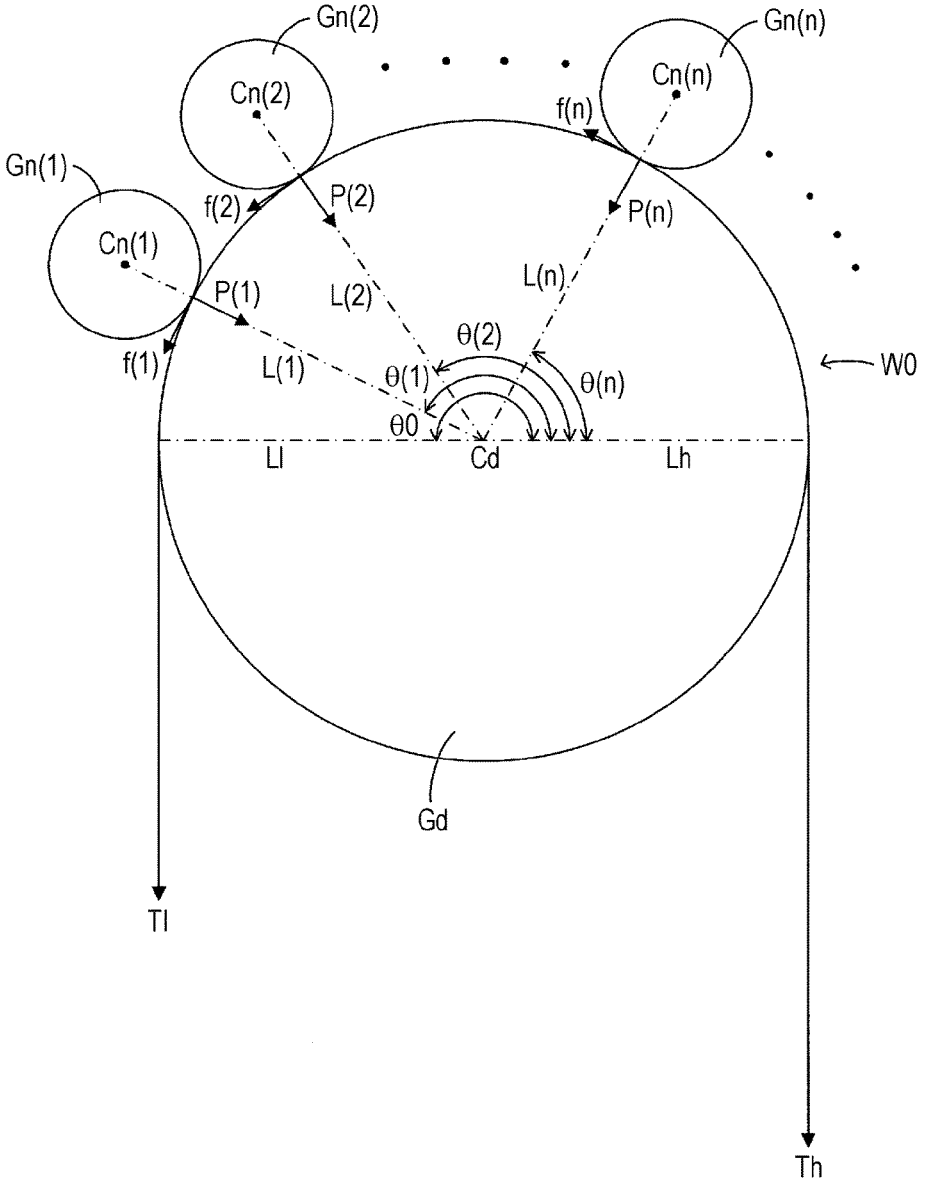

[Fig. 9]
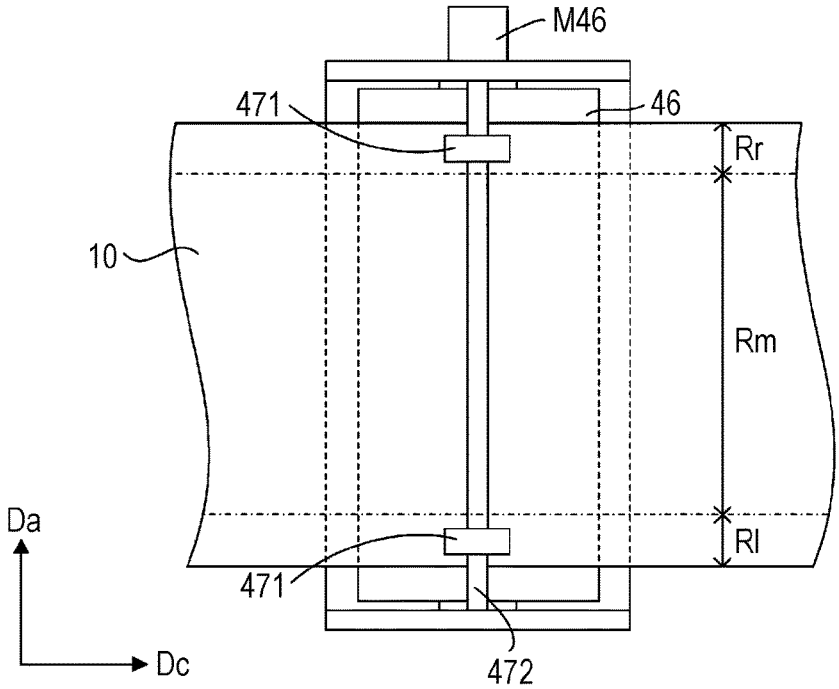
[Fig. 10]
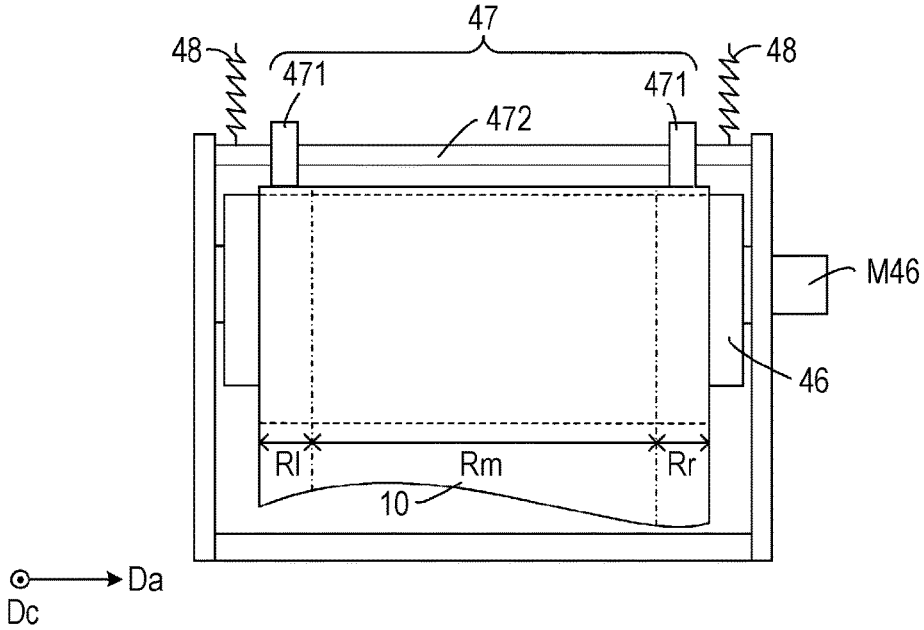

[Fig. 11]
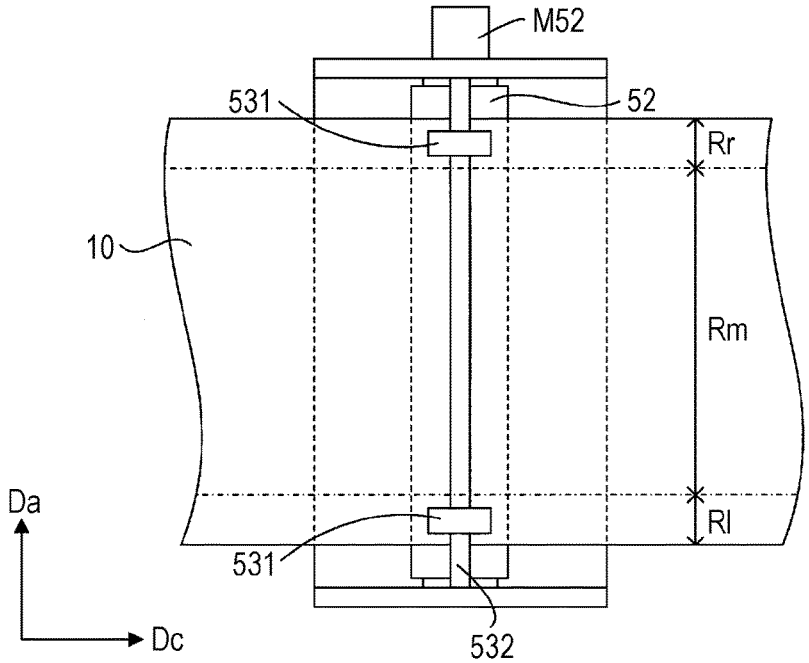
[Fig. 12]
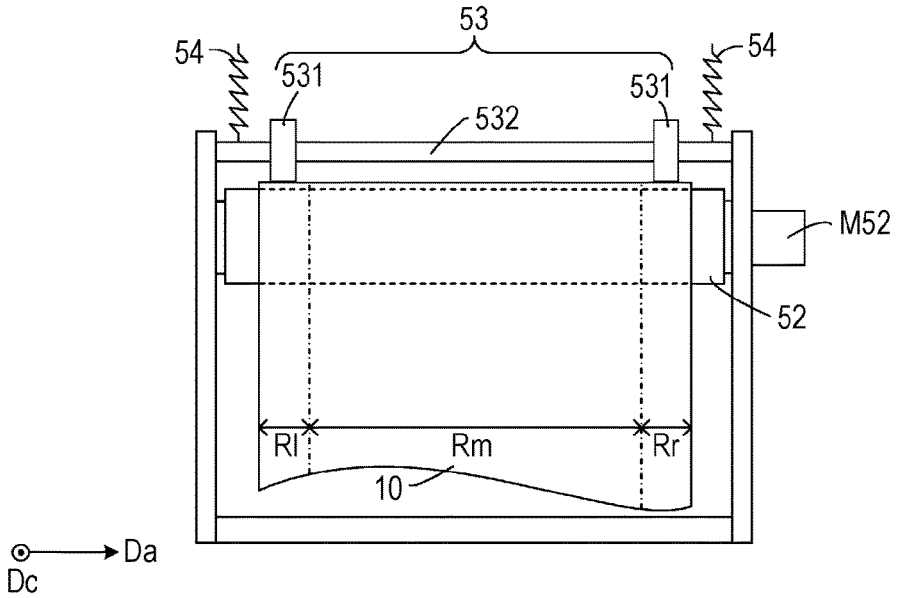

WEB TRANSPORTING APPARATUS, WEB TRANSPORTING METHOD, IMAGE FORMING APPARATUS, AND IMAGE FORMING METHOD

TECHNICAL FIELD

The invention relates to technology in which a drive roller is rotated while nipping a web between the drive roller and a driven roller to transport the web.

BACKGROUND ART

The web transporting apparatus described in PTL 1 transports a web by rotating a drive roller while nipping (pressing) the web between the drive roller and a driven roller. In the web transporting apparatus, there is a case in which the transportation of the web may not be appropriately executed when slipping occurs between the drive roller and the web.

CITATION LIST

Patent Literature

PTL 1: JP-A-2007-112532

SUMMARY OF INVENTION

Technical Problem

In particular, when there is a tension difference in the web between the front and rear of the portion which is nipped between the drive roller and the driven roller, the web will slip easily from a low tension side to a high tension side. However, sufficient consideration is not given regarding countermeasures to the slipping of the web caused by such a tension difference.

The invention takes the above issues into consideration, and the object is to provide technology capable of suppressing the occurrence of slipping of a web regardless of a tension difference in the web between the front and rear of the portion which is nipped between a drive roller and a driven roller.

Solution to Problem

In order to achieve the object described above, a web transporting apparatus according to a first aspect of the invention includes a drive roller which winds a web, N (where N is an integer of 1 or greater) driven rollers which nip a wound portion, which is a portion of the web which is wound around the drive roller, between the drive roller and the driven rollers; and a tension application unit which applies a tension Tl to a portion of the web which is one side of the wound portion and applies a tension Th which is higher than the tension Tl to a portion of the web which is opposite the one side of the wound portion, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the nth driven roller and the center of rotation of the drive roller is set to a straight line L(n), where n is an integer of 1 or greater counting the driven rollers along the wound portion from the one side, an angle which is formed by the straight line Ll and the straight line Lh along the wound portion around the center of rotation of the drive roller is set to an angle θ0, an angle which is formed by the straight line L(n) and the straight line Lh along the wound portion around the center of rotation of the drive roller is set to an angle θ(n), a load which is applied to the drive roller from the nth driven roller is set to a load P(n), a static friction coefficient between the drive roller and the web in the wound portion is set to μ0, a static friction coefficient between the drive roller and the web in a range which is pinched between the nth driven roller and the drive roller is set to μ(n), and the driven rollers are provided so as to satisfy a following expression.

[Math. 1]

$$Th < T1 \cdot \exp(\mu 0 \cdot \theta 0) + \sum_{n=1}^{N} f(n) \cdot \exp\{\mu 0 \cdot \theta(n)\} \tag{1}$$

$$f(n) = \mu(n) \cdot P(n)$$

In order to achieve the object described above, an image forming apparatus according to the first aspect of the invention includes a web transporting apparatus which transports a web, and an image recording section which records an image on the web which is transported by the web transporting apparatus, in which the web transporting apparatus includes a drive roller which winds the web N (where N is an integer of 1 or greater) driven rollers which nip a wound portion, which is a portion of the web which is wound around the drive roller, between the drive roller and the driven rollers, and a tension application unit which applies a tension Tl to a portion of the web which is one side of the wound portion and applies a tension Th which is higher than the tension Tl to a portion of the web which is opposite the one side of the wound portion, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the nth driven roller and the center of rotation of the drive roller is set to a straight line L(n), where n is an integer of 1 or greater counting the driven rollers along the wound portion from the one side, an angle which is formed by the straight line Ll and the straight line Lh along the wound portion around the center of rotation of the drive roller is set to an angle θ0, an angle which is formed by the straight line L(n) and the straight line Lh along the wound portion around the center of rotation of the drive roller is set to an angle θ(n), a load which is applied to the drive roller from the nth driven roller is set to a load P(n), a static friction coefficient between the drive roller and the web in the wound portion is set to μ0, a static friction coefficient between the drive roller and the web in a range which is pinched between the nth driven roller and the drive roller is set to μ(n), and the driven rollers are provided so as to satisfy a following expression.

[Math. 1]

$$Th < T1 \cdot \exp(\mu 0 \cdot \theta 0) + \sum_{n=1}^{N} f(n) \cdot \exp\{\mu 0 \cdot \theta(n)\} \quad (1)$$

$$f(n) = \mu(n) \cdot P(n)$$

In order to achieve the object described above, a web transporting method according to the first aspect of the invention includes winding a web around a drive roller, applying a tension Tl to a portion of the web which is one side of a wound portion, which is a portion of the web which is wound around the drive roller, and applies a tension Th which is higher than the tension Tl to a portion of the web which is opposite the one side of the wound portion, and transporting the web by rotating the drive roller in a state in which the wound portion is nipped between the drive roller and N (where N is an integer of 1 or greater) driven rollers, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the nth driven roller and the center of rotation of the drive roller is set to a straight line L(n), where n is an integer of 1 or greater counting the driven rollers along the wound portion from the one side, an angle which is formed by the straight line Ll and the straight line Lh along the wound portion around the center of rotation of the drive roller is set to an angle θ0, an angle which is formed by the straight line L(n) and the straight line Lh along the wound portion around the center of rotation of the drive roller is set to an angle θ(n), a load which is applied to the drive roller from the nth driven roller is set to a load P(n), a static friction coefficient between the drive roller and the web in the wound portion is set to μ0, a static friction coefficient between the drive roller and the web in a range which is pinched between the nth driven roller and the drive roller is set to μ(n), and a following expression is satisfied.

[Math. 1]

$$Th < T1 \cdot \exp(\mu 0 \cdot \theta 0) + \sum_{n=1}^{N} f(n) \cdot \exp\{\mu 0 \cdot \theta(n)\} \quad (1)$$

$$f(n) = \mu(n) \cdot P(n)$$

In order to achieve the object described above, an image forming method according to the first aspect of the invention includes winding a web around a drive roller, applying a tension Tl to a portion of the web which is one side of a wound portion, which is a portion of the web which is wound around the drive roller, and applies a tension Th which is higher than the tension Tl to a portion of the web which is opposite the one side of the wound portion, and recording an image on the web while transporting the web by rotating the drive roller in a state in which the wound portion is nipped between the drive roller and N (where N is an integer of 1 or greater) driven rollers, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the nth driven roller and the center of rotation of the drive roller is set to a straight line L(n), where n is an integer of 1 or greater counting the driven rollers along the wound portion from the one side, an angle which is formed by the straight line Ll and the straight line Lh along the wound portion around the center of rotation of the drive roller is set to an angle θ0, an angle which is formed by the straight line L(n) and the straight line Lh along the wound portion around the center of rotation of the drive roller is set to an angle θ(n), a load which is applied to the drive roller from the nth driven roller is set to a load P(n), a static friction coefficient between the drive roller and the web in the wound portion is set to μ0, a static friction coefficient between the drive roller and the web in a range which is pinched between the nth driven roller and the drive roller is set to μ(n), and a following expression is satisfied.

[Math. 1]

$$Th < T1 \cdot \exp(\mu 0 \cdot \theta 0) + \sum_{n=1}^{N} f(n) \cdot \exp\{\mu 0 \cdot \theta(n)\} \quad (1)$$

$$f(n) = \mu(n) \cdot P(n)$$

Note that exp(x) is the x exponent of e which is the base of a natural logarithm, that is, exp(x) indicates $e^x$.

In the invention described in this manner, the web which is wound around the drive roller is nipped between the drive roller and the N driven rollers. The tension Tl is applied to the web which is one side of the wound portion, and the tension Th which is greater than the tension Tl is applied to the web which is the other side of the wound portion. In this configuration, there is a concern that the web will slip from the low tension side (the one side) to the high tension Th side (the other side). To counteract the slipping, expression 1 is satisfied in the first aspect of the invention. Therefore, as described below, it is possible to secure the static friction force which acts against the difference between the tensions Th and Tl between the web and the drive roller, and it becomes possible to suppress the occurrence of slipping of the web.

At this time, the number of the driven rollers which nip the web between the drive roller and the driven rollers may be one or a plurality. In particular, when the number of the driven rollers is 1, that is, when N=1, expression 1 described above is as follows.

$$Th < Tl \times \exp(\mu 0 \times \theta 0) + f(1) \times \exp\{\theta 0 \times \theta(1)\}$$

Incidentally, when θ0>θ(1), the driven rollers may be provided so as to satisfy θ0 −θ(1)<θ(1). Accordingly, it is possible to also accomplish the effect of the second aspect of the invention described later, and it becomes possible to suppress the occurrence of slipping of the web more reliably.

Alternatively, when the end of one side of the wound portion is positioned on the straight line L(1) and θ0=θ(1), expression 1 becomes Th<{Tl+f(1)}×exp(μ0×θ0).

In order to achieve the object described above, a web transporting apparatus according to a second aspect of the invention includes a drive roller which winds a web, N (where N is an integer of 1 or greater) driven rollers which nip a wound portion, which is a portion of the web which is wound around the drive roller, between the drive roller and the driven rollers, and a tension application unit which applies a tension Tl to a portion of the web which is one side of the wound portion and applies a tension Th which is higher than the tension Tl to a portion of the web which is opposite the one side of the wound portion, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the first driven roller, counting the driven rollers along the wound portion from the one side, and the center of rotation of the drive roller is set to a straight line L(1), an angle which is formed by the straight line Ll and the straight line Lh along the wound portion around the center of rotation of the drive roller is set to an angle θ0, an angle which is formed by the straight line L(1) and the straight line Lh along the wound portion around the center of rotation of the drive roller is set to an angle θ(1), and the driven rollers are provided so as to satisfy a following expression.

$$0<\theta 0-\theta(1)<\theta(1) \qquad \text{Expression 2}$$

In order to achieve the object described above, an image forming apparatus according to the second aspect of the invention includes a web transporting apparatus which transports a web, and an image recording section which records an image on the web which is transported by the web transporting apparatus, in which the web transporting apparatus includes a drive roller which winds the web, N (where N is an integer of 1 or greater) driven rollers which nip a wound portion, which is a portion of the web which is wound around the drive roller, between the drive roller and the driven rollers, and a tension application unit which applies a tension Tl to a portion of the web which is one side of the wound portion and applies a tension Th which is higher than the tension Tl to a portion of the web which is opposite the one side of the wound portion, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the first driven roller, counting the driven rollers along the wound portion from the one side, and the center of rotation of the drive roller is set to a straight line L(1), an angle which is formed by the straight line Ll and the straight line Lh along the wound portion around the center of rotation of the drive roller is set to an angle θ0, an angle which is formed by the straight line L(1) and the straight line Lh along the wound portion around the center of rotation of the drive roller is set to an angle θ(1), and the driven rollers are provided so as to satisfy a following expression.

$$0<\theta 0-\theta(1)<\theta(1) \qquad \text{Expression 2}$$

In order to achieve the object described above, a web transporting method according to the second aspect of the invention includes winding a web around a drive roller, applying a tension Tl to a portion of the web which is one side of a wound portion, which is a portion of the web which is wound around the drive roller, and applies a tension Th which is higher than the tension Tl to a portion of the web which is opposite the one side of the wound portion, and transporting the web by rotating the drive roller in a state in which the wound portion is nipped between the drive roller and N (where N is an integer of 1 or greater) driven rollers, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the first driven roller, counting the driven rollers along the wound portion from the one side, and the center of rotation of the drive roller is set to a straight line L(1), an angle which is formed by the straight line Ll and the straight line Lh along the wound portion around the center of rotation of the drive roller is set to an angle θ0, an angle which is formed by the straight line L(1) and the straight line Lh along the wound portion around the center of rotation of the drive roller is set to an angle θ(1), and a following expression is satisfied.

$$0<\theta 0-\theta(1)<\theta(1) \qquad \text{Expression 2}$$

In order to achieve the object described above, an image forming method according to the second aspect of the invention includes winding a web around a drive roller, applying a tension Tl to a portion of the web which is one side of a wound portion, which is a portion of the web which is wound around the drive roller, and applies a tension Th which is higher than the tension Tl to a portion of the web which is opposite the one side of the wound portion, and recording an image on the web while transporting the web by rotating the drive roller in a state in which the wound portion is nipped between the drive roller and N (where N is an integer of 1 or greater) driven rollers, in which in front view as viewed from an axial direction of the drive roller, a straight line which passes through an end of the one side of the wound portion and a center of rotation of the drive roller is set to a straight line Ll, a straight line which passes through an end of the other side of the wound portion and the center of rotation of the drive roller is set to a straight line Lh, a straight line which passes through the center of rotation of the first driven roller, counting the driven rollers along the wound portion from the one side, and the center of rotation of the drive roller is set to a straight line L(1), an angle which is formed by the straight line Ll and the straight line Lh along the wound portion around the center of rotation of the drive roller is set to an angle θ0, an angle which is formed by the straight line L(1) and the straight line Lh along the wound portion around the center of rotation of the drive roller is set to an angle θ(1), and a following expression is satisfied.

$$0<\theta 0-\theta(1)<\theta(1) \qquad \text{Expression 2}$$

In the invention described in this manner, the web which is wound around the drive roller is nipped between the drive roller and the N driven rollers. The tension Tl is applied to the web which one side of the wound portion, and the tension Th which is greater than the tension Tl is applied to the web which is the other side of the wound portion. In this configuration, there is a concern that the web will slip from the low tension side (the one side) to the high tension Th side (the other side). To counteract the slipping, expression 2 is satisfied in a second aspect of the invention. In other words, the wound portion has a wider range on the high tension side than the low tension side, using the first driven roller as the base point, counting from the low tension side (the one side). In this manner, by winding the web around a wider range on the high tension side, it is possible to secure the static friction force which acts against the difference between the tensions Th and Tl between the web and the drive roller, and it becomes possible to suppress the occurrence of slipping of the web.

Incidentally, the number of the driven rollers which nip the web between the drive roller and the driven rollers may be one or a plurality, and N may be 1 or an integer of 2 or greater.

BRIEF DESCRIPTION OF DRAWINGS

FIG. 1 is a partial front view schematically illustrating an example of a printer according to the invention.

FIG. 2 is a block diagram schematically illustrating an example of the electrical configuration which controls the printer.

FIG. 3A is an explanatory diagram for describing the conditions for suppressing slipping of a web.

FIG. 3B is an explanatory diagram for describing the conditions for suppressing slipping of a web.

FIG. 4A is a diagram illustrating a measurement method of a static friction coefficient μ0.

FIG. 4B is a diagram illustrating a measurement method of a static friction coefficient μ(1).

FIG. 5A is a table illustrating measurement results of the static friction coefficient μ0 in table format.

FIG. 5B is a table illustrating measurement results of the static friction coefficient μ(1) in table format.

FIG. 6 is a table illustrating measurement results of tension values when the slipping of the web occurs.

FIG. 7 is a diagram schematically illustrating a positional relationship between a drive roller and a nip roller.

FIG. 8 is a diagram schematically illustrating a positional relationship between the drive roller and one or more of the nip rollers.

FIG. 9 is a plan view schematically illustrating a modification example of the nip roller.

FIG. 10 is a side view schematically illustrating a modification example of the nip roller.

FIG. 11 is a plan view schematically illustrating a modification example of the nip roller.

FIG. 12 is a side view schematically illustrating a modification example of the nip roller.

DESCRIPTION OF EMBODIMENT

FIG. 1 is a partial front view schematically illustrating an example of a printer according to the invention. As illustrated in FIG. 1, a printer 1 records an image onto the obverse surface of a long web 10 while transporting the web 10 in a transport direction Dc using a web transporting apparatus A. The type of substrate of the web 10 may be largely divided into paper-based and film-based. Specific examples include high quality paper, cast paper, art paper, coated paper, and the like for a paper-based substrate, and synthetic paper, polyethylene terephthalate (PET) film, polypropylene (PP) film, and the like for a film-based substrate. The web transporting apparatus A is provided with a feed section 2, a buffer section 3, a process section 4, and a carry-out section 5 provided along the transport direction Dc.

The feed section 2 includes a feed shaft 21, a driven roller 22, a drive roller 23, and a nip roller 24. The feed shaft 21 supports the web 10 with the end of the web 10 in the transport direction Dc wound around the feed shaft 21 in a state in which the obverse surface of the web 10 faces the outside, and the web 10 is wound around the driven roller 22 from the reverse surface (the surface of the opposite side from the obverse surface) between the feed shaft 21 and the drive roller 23 in the transport direction Dc. Therefore, when the feed shaft 21 rotates clockwise from the perspective of FIG. 1, the web 10 which is wound around the feed shaft 21 is fed to the drive roller 23 via the driven roller 22.

The drive roller 23 is formed of a metal roller with a smooth surface, a spray coated roller with a surface including minute unevenness, or the like, and the web 10 is wound around the drive roller 23 from the reverse surface. Therefore, when the drive roller 23 rotates clockwise from the perspective of FIG. 1, the web 10 is fed to the buffer section 3 of the downstream side in the transport direction Dc by a static friction force which arises between the drive roller 23 and the web 10. The nip roller 24 rotates to follow the movement of the web 10 which is driven by the drive roller 23 while nipping the web 10 between the drive roller 23 and the nip roller 24 by abutting the entire region of the web 10 in the axial direction. The nip roller 24 is biased toward the drive roller 23 side by an elastic member 25 (a load generating unit) such as a spring, and, receiving the force (an elastic force) generated by the elastic member 25, presses the drive roller 23 with a predetermined load (a nipping load). By nipping the web 10 with a predetermined load using the drive roller 23 and the nip roller 24, it is possible to secure the static friction force between the drive roller 23 and the web 10 and to transport the web 10 toward the downstream side of the transport direction Dc in a stable manner.

The feed section 2 includes a splicing table 28. The splicing table 28 is disposed between the driven roller 22 and the drive roller 23 in the transport direction Dc so as to face the reverse surface of the web 10, and a worker is capable of performing a task (splicing) of joining a new web 10 to an old web 10 using the splicing table 28.

The buffer section 3 includes a dancer roller 31 and a driven roller 32. The dancer roller 31 is supported by its own weight to be capable of moving in a vertical direction, and the web 10 is wound around the dancer roller 31 from the obverse surface between the drive roller 23 and the driven roller 32 in the transport direction Dc. The dancer roller 31 rises or falls according to a decrease or an increase in the length of the web 10 between the drive roller 23 and the driven roller 32. By providing the dancer roller 31, it is possible to alleviate the influence which the tension of the web 10 at the feed section 2 and the tension of the web 10 at the process section 4 have on each other.

The process section 4 includes, provided in the transport direction Dc, a steering unit 7, driven rollers 41, 42, and 43, and a rotating drum 46. The steering unit 7 includes a drive roller 71 and a nip roller 72. The drive roller 71 is formed of a metal roller with a smooth surface, a spray coated roller with a surface including minute unevenness, or the like, and the web 10 is wound around the drive roller 71 from the reverse surface. Therefore, when the drive roller 71 rotates clockwise from the perspective of FIG. 1, the web 10 is transported to the driven roller 41 of the downstream side in the transport direction Dc by the static friction force which arises between the drive roller 71 and the web 10. The nip roller 72 rotates to follow the movement of the web 10 which is driven by the drive roller 71 while nipping the web 10 between the drive roller 71 and the nip roller 72 by abutting the entire region of the web 10 in the axial direction. The nip roller 72 is biased toward the drive roller 71 side by an elastic member 73 (a load generating unit) such as a spring, and, receiving the force (an elastic force) generated by the elastic member 73, presses the drive roller 71 with a predetermined load (a nipping load). By nipping the web 10 with a predetermined load using the drive roller 71 and the nip roller 72, it is possible to secure the static friction force between the drive roller 71 and the web 10 and to transport the web 10 toward the downstream side of the transport direction Dc in a stable manner.

The steering unit 7 is capable of adjusting the inclination of the web 10 by rocking the drive roller 71 and the nip roller 72. This is executed with the aim of correcting the inclination of the web 10, which is wound around the rotating drum 46 and is subjected to image recording by recording heads 81, by adjusting the inclination of the web 10 in relation to the rotating shaft of the rotating drum 46 before the web 10 reaches the rotating drum 46.

The driven rollers 41 to 43, the web 10 being wound around each of which from the obverse surface, are provided between the steering unit 7 and the rotating drum 46 in the transport direction Dc. Therefore, the web 10, the inclination of which is adjusted by the steering unit 7, reaches the rotating drum 46 via the driven rollers 41 to 43. The rotating drum 46 is formed of a light metal such as aluminum, has a smooth circumferential surface or a surface with minute unevenness, and the web 10 is wound around the rotating drum 46 from the reverse surface. Therefore, when the rotating drum 46 rotates clockwise from the perspective of FIG. 1, the web 10 is transported toward the carry-out section 5 of the downstream side in the transport direction Dc by the static friction force which arises between the rotating drum 46 and the web 10. The process section 4 includes a nip roller 47. The nip roller 47 rotates to follow the movement of the web 10 which is driven by the rotating drum 46 while nipping the web 10 between the rotating drum 46 and the nip roller 47 by abutting the entire region of the web 10 in the axial direction. The nip roller 47 is biased toward the rotating drum 46 side by an elastic member 48 (a load generating unit) such as a spring, and, receiving the force (an elastic force) generated by the elastic member 48, presses the rotating drum 46 with a predetermined load (a nipping load). By nipping the web 10 with a predetermined load using the rotating drum 46 and the nip roller 47, it is possible to secure the static friction force between the rotating drum 46 and the web 10 and to transport the web 10 toward the downstream side of the transport direction Dc in a stable manner.

The carry-out section 5 includes a web suction device 51 (an air pump), a drive roller 52, and a nip roller 53. The web suction device 51 applies an appropriate tension to the web 10 by suctioning the web 10 from the reverse surface, the web 10 being slack between the rotating drum 46 and the drive roller 52 in the transport direction Dc. The drive roller 52 is formed of a metal roller with a smooth surface, a spray coated roller with a surface including minute unevenness, or the like, and the web 10 is wound around the drive roller 52 from the reverse surface. Therefore, when the drive roller 52 rotates clockwise from the perspective of FIG. 1, the web 10 is carried out to the downstream side (that is, to the outside of the printer 1) in the transport direction Dc by a static friction force which arises between the drive roller 52 and the web 10. The nip roller 53 rotates to follow the movement of the web 10 which is driven by the drive roller 52 while nipping the web 10 between the drive roller 52 and the nip roller 53 by abutting the entire region of the web 10 in the axial direction. The nip roller 53 is biased toward the drive roller 52 side by an elastic member 54 (a load generating unit) such as a spring, and presses the drive roller 52 with a predetermined load (a nipping load) using the force (an elastic force) generated by the elastic member 54. In this manner, by nipping the web 10 with a predetermined load using the drive roller 52 and the nip roller 53, it is possible to secure the static friction force between the drive roller 52 and the web 10 and to transport the web 10 toward the downstream side of the transport direction Dc in a stable manner.

The printer 1 is provided with an image recording section 8. The image recording section 8 includes six of the recording heads 81 facing the obverse surface of the web 10 which is wound around the circumferential surface of the rotating drum 46 in the process section 4. The recording heads 81 are lined up in the transport direction Dc along the rotating drum 46, and record an image on the obverse surface of the web 10 by ejecting aqueous inks of different colors from each other onto the obverse surface of the web 10. It is possible to use a piezo or thermal ink jet type head as the recording head 81.

The description above summarizes the mechanical configuration of the printer 1. Next, description will be given of the electrical configuration which controls the printer 1. FIG. 2 is a block diagram schematically illustrating an example of the electrical configuration which controls the printer illustrated in FIG. 1. The printer 1 is provided with a printer control unit 100 which controls the components of the printer 1. The operations of the web transporting apparatus A and the image recording section 8 are controlled by the printer control unit 100.

The web transporting apparatus A is provided with transport motors M21, M23, M71, M46, and M52 which are connected to the feed shaft 21, the drive roller 23, the drive roller 71, the rotating drum 46, and the drive roller 52, respectively. The printer control unit 100 controls the transportation of the web 10 by controlling the speed or the torque of each of the motors. The web transportation control is as follows.

The printer control unit 100 causes the transport motor M21 which drives the feed shaft 21 to rotate to supply the web 10 to the drive roller 23 from the feed shaft 21. At this time, the printer control unit 100 adjusts the tension (the feed tension) of the web 10 from the feed shaft 21 to the drive roller 23 by controlling the torque of the transport motor M21.

In other words, a tension sensor S22 is attached to the driven roller 22. The tension sensor S22 detects the feed tension using a load cell which measures the magnitude of the force received from the web 10. The printer control unit 100 subjects the torque of the transport motor M21 to feedback control based on the detection result (a detected value) of the tension sensor S22. Accordingly, the torque (breaking torque) which is applied to the web 10 by the transport motor M21 against the transportation in the transport direction Dc performed by the drive roller 23 is controlled, and the feed tension of the web 10 is adjusted to be substantially fixed.

While the printer control unit 100 subjects the transport motor M21 which drives the feed shaft 21 to torque control, the printer control unit 100 also subjects the transport motor M23 which drives the drive roller 23 to speed control. In other words, the web transporting apparatus A includes an optical distance sensor S31 above the dancer roller 31. The distance sensor S31 measures the distance to the dancer roller 31. The printer control unit 100 subjects the speed of the transport motor M23 to feedback control based on the detection result (the detected value) of the distance sensor S31. Accordingly, the distance from the distance sensor S31 to the dancer roller 31, in other words, the position of the dancer roller 31 in the vertical direction is adjusted to be substantially fixed.

The printer control unit 100 causes the transport motor M71 which drives the drive roller 71 and the transport motor M46 which drives the rotating drum 46 to rotate to transport the web 10 in the transport direction Dc. At this time, the printer control unit 100 adjusts the tension (the process tension) of the web 10 which is wound around the rotating drum 46 by subjecting the transport motor M71 to torque control.

In other words, a tension sensor S42 is attached to the driven roller 42. The tension sensor S42 detects the process tension using a load cell which measures the magnitude of the force received from the web 10. The printer control unit 100 subjects the torque of the transport motor M71 to feedback control based on the detection result (a detected value) of the tension sensor S42. Accordingly, the torque (breaking torque) which is applied to the web 10 by the transport motor M71 against the transportation in the transport direction Dc performed by the rotating drum 46 is controlled, and the process tension of the web 10 is adjusted to be substantially fixed.

Meanwhile, the printer control unit 100 subjects the transport motor M46 to speed control. In other words, the printer control unit 100 adjusts the rotation speed of the transport motor M46 to be substantially fixed based on the output of an encoder of the transport motor M46. In this manner, the web 10 is transported in the transport direction Dc at a fixed speed by the rotating drum 46.

The printer control unit 100 subjects the transport motor M52 which drives the drive roller 52 to speed control. In other words, the web transporting apparatus A includes an optical distance sensor S51 above the web suction device 51 to interpose the web 10 therebetween. The distance sensor S51 measures the distance to the web 10 which is suctioned by the web suction device 51 between the nip roller 47 and the drive roller 52 in the transport direction Dc. The printer control unit 100 subjects the speed of the transport motor M52 to feedback control based on the detection result (the detected value) of the distance sensor S51. Accordingly, the distance from the distance sensor S51 to the web 10, in other words, the position of the web 10 which is suctioned by the web suction device 51 in the vertical direction is adjusted to be substantially fixed.

The printer control unit 100 causes the drive roller 71 and the nip roller 72 of the steering unit 7 to rock, as appropriate, in order to suppress the inclination (skewing) of the web 10 which enters the rotating drum 46. In other words, the web transporting apparatus A includes an optical end portion sensor S7 between the drive roller 71 and the driven roller 41 in the transport direction Dc. The end portion sensor S7 detects the end portion (the end portion in a direction orthogonally intersecting the transport direction Dc) of the web 10. The web transporting apparatus A includes a steering motor M7 which drives the drive roller 71 and the driven roller 41 in a rocking direction. The printer control unit 100 controls the driving which is carried out by the steering motor M7 based on the detection result (the detected value) of the end portion sensor S7. Accordingly, the inclination of the web 10 which is moving from the steering unit 7 toward the transport direction Dc is adjusted, and the inclination of the web 10 which enters the rotating drum 46 is suppressed.

The printer control unit 100 controls the timing at which each of the recording heads 81 ejects the ink according to the speed at which the web 10 is transported by the rotating drum 46. Accordingly, it is possible to cause the ink to land on an appropriate position of the web 10 to record a high definition image.

The description above summarizes the electrical configuration of the printer 1. As described above, the web transporting apparatus A transports the web 10 in the transport direction Dc while nipping the web 10, as appropriate, between the drive rollers and the nip rollers. In the web transporting apparatus A, it is important to suppress the slipping of the web 10 in relation to the drive rollers. Therefore, the present inventor considered the conditions for suppressing the slipping of the web 10 in detail, and obtained the following findings.

FIGS. 3A and 3B are explanatory diagrams for describing the conditions for suppressing slipping of a web, and illustrate front views as viewed from the axial direction (the direction in which the center line of rotation of the drive roller extends) of a drive roller. In FIGS. 3A and 3B, and the following drawings, the reference symbol Gd indicates a cylindrical rotating member which is driven by a motor, and corresponds to the drive rollers 23, 71, 52, and the rotating drum 46 of the web transporting apparatus A, for example. The reference symbol Gn indicates a nip roller, and corresponds to the nip rollers 24, 72, 53, and 47 of the web transporting apparatus A, for example.

First, when the web 10 is given a tension difference at both sides of a wound portion W0 while the web 10 is wound around the drive roller Gd which is fixed so as not to rotate around a center of rotation Cd, consideration will be given to the conditions in which the static friction force between the drive roller Gd and the web 10 and the tension difference balance each other out. In FIGS. 3A and 3B, by applying a tension Tl to a portion of the web 10 which is one side of the wound portion W0 and applying a tension Th(>Tl) which is higher than the tension Tl to a portion of the web 10 which is the other side of the wound portion W0, a tension difference (=Th−Tl) is generated in the web 10 at both sides of the wound portion W0.

Here, the wound portion W0 is a portion of the web 10 which is wound around (in contact with) the drive roller Gd. In FIGS. 3A and 3B, a virtual line which passes through the end of the one side (the low tension Tl side) of the wound portion W0 and the center of rotation Cd of the drive roller Gd is illustrated as a straight line Ll, and a virtual line which passes through the end of the other side (the high tension Th side) of the wound portion W0 and the center of rotation Cd of the drive roller Gd is illustrated as a straight line Lh. An angle (a wind-around angle) which is formed by the straight line Ll and the straight line Lh along the wound portion W0 around the center of rotation Cd of the drive roller Gd is illustrated as an angle θ0.

In a state in which the nip roller Gn is not provided illustrated in FIG. 3A, the conditions in which the static friction force between the drive roller Gd and the web 10 and the tension difference balance each other out are obtained from Euler's belt formula and are expressed in equation 3 below.

$$Th = Tl \times \exp(\mu 0 \times \theta 0) \qquad \text{Equation 3}$$

Here, "μ0" is a static friction coefficient between the drive roller Gd and the web 10 in the wound portion W0.

The present inventor expanded the above equation 3 which is obtained from Euler's belt formula to cover a case in which the nip roller Gn is provided. In other words, in a state in which the wound portion W0 is nipped between the nip roller Gn and the drive roller Gd as illustrated in FIG. 3B, it is discovered that the conditions in which the static friction force between the drive roller Gd and the web 10 and the tension difference balance each other out are as follows.

$$Th=\{Tl+f(1)\}\times\exp(\mu 0\times\theta 0)$$

$$f(1)=\mu(1)\times P(1) \qquad \text{Equation 4}$$

Here, "μ(1)" is the static friction coefficient between the drive roller Gd and the web 10 in the range (a nipped portion) which is pinched between the nip roller Gn and the drive roller Gd, and "P(1)" is the load (the nipping load) which is applied to the drive roller Gd from the nip roller Gn.

The present inventor empirically confirmed that equation 4 was satisfied. Specifically, the value of the tension Th was gradually increased while applying a fixed tension Tl, and the value of the tension Th was obtained when slipping of the web 10 in relation to the drive roller Gd occurred. It was confirmed that the values of the tensions Tl and Th during the occurrence of the slipping satisfy the equation 4. Next, detailed description will be given of the experiment.

First, the static friction coefficients μ0 and μ(1) were measured before obtaining the tension Th during the occurrence of the slipping. FIGS. 4A and 4B are diagrams illustrating the measurement methods of the static friction coefficients μ0 and μ(1). In particular, FIG. 4A illustrates the measurement method of the static friction coefficient μ0, and FIG. 4B illustrates the measurement method of the static friction coefficient μ(1). FIGS. 5A and 5B are diagrams illustrating the measurement results of the static friction coefficients μ0 and μ(1) in table format. In particular, FIG. 5A illustrates the measurement results of the static friction coefficient μ0, and FIG. 5B illustrates the measurement results of the static friction coefficient μ(1). In each measurement of the static friction coefficients μ0 and μ(1), a spray coated roller with a plurality of minute protrusions which are formed by spray coating on the outer circumferential surface thereof was used as the drive roller Gd, and a 330 mm wide AA239 (PP30 TOP CLEAR/S4000/PET30) web of the Avery Dennison Corporation was used as the web 10.

In the measurement of the static friction coefficient μ0 illustrated in FIG. 4A, while winding the web 10 around the drive roller Gd which is fixed in a non-rotatable manner at a winding angle θ0(=87.3°), a weight of a weight K (=200 gf) was hung from the other side of the wound portion W0 of the web 10. The force to be applied to the one side of the wound portion W0 of the web 10 was gradually increased, and the value of the force at the time at which slipping of the web 10 in relation to the drive roller Gd occurred was obtained as a maximum static friction force F. The static friction coefficient μ0 was calculated by incorporating the measured value of the maximum static friction force F into the following equation which is obtained from Euler's belt formula.

$$\mu 0=(1/\theta 0)\times\ln(F/K)$$

The results of performing the measurement seven times are illustrated in the table illustrated in FIG. 5A. The average value of the static friction coefficients μ0 was determined to be 0.252.

In the measurement of the static friction coefficient μ(1) illustrated in FIG. 4B, the web 10 was nipped between the drive roller Gd which is fixed in a non-rotatable manner, and the nip roller Gn which is configured such that the circumferential surface thereof is urethane, EPDM, or the like, and is rotatable. At this time, a nipping load P (1) to be applied to the drive roller Gd from the nip roller Gn was set to 73 N. The web 10 was supported in a straight manner so as to orthogonally intersect a straight line passing through each center of rotation of the drive roller Gd and the nip roller Gn, and was not wound around the drive roller Gd. The force to be applied to the one side of the wound portion W0 of the web 10 was gradually increased in a state in which no force was applied to the other side of the wound portion W0 of the web 10, and the value of the force at the time at which slipping of the web 10 in relation to the drive roller Gd occurred was obtained as the maximum static friction force F. The static friction coefficient μ(1) was calculated by incorporating the measured value of the maximum static friction force F into the following equation which is satisfied between the nipping load P(1) and the maximum static friction force F.

$$F=\mu(1)\times P(1)$$

The results of performing the measurement seven times are illustrated in the table illustrated in FIG. 5B. The average value of the static friction coefficients μ(1) was determined to be 0.778.

An experiment was carried out to confirm that the following equation 4 was satisfied after obtaining the actual measured values of the static friction coefficients μ0 and μ(1). In the experiment, in the configuration illustrated in FIG. 3B, the web 10 was nipped between the drive roller Gd which has protrusions which are formed on the circumferential surface thereof using spray coating and is fixed in a non-rotatable manner, and the nip roller Gn which is configured such that the circumferential surface thereof is urethane, EPDM, or the like, and is rotatable. The other experimental conditions were as follows.

Tension Tl 25 N

Static friction coefficient μ0 of wound portion W0 0.252 (actual measured value)

Static friction coefficient μ(1) of nipped portion 0.778 (actual measured value)

Nipping load P(1) 73 N (actual measured value)

Winding angle θ0 150°

Web 10 AA239 described above

Under the experimental conditions, the value of the tension Th was gradually increased in stages of 5 N at a time while applying a fixed tension Tl, and the value of the tension Th was obtained as the maximum static friction force F when slipping of the web 10 in relation to the drive roller Gd occurred. The results of performing the measurement seven times are illustrated in the table illustrated in FIG. 6. Here, FIG. 6 is a diagram illustrating, in table format, the measurement results of the tension values when the slipping of the web in relation to the drive roller occurs. In this manner, the average value of the tension Th (the maximum static friction force) during the occurrence of slipping was determined to be 156 N.

Meanwhile, by incorporating the experimental conditions described above into equation 4, when the calculated value of the tension Th (the maximum static friction force) during the occurrence of slipping was obtained, the result was as follows.

$$Th=\{Tl+f(1)\}\times\exp(\mu 0\times\theta 0)=158\text{ N}$$

In other words, the actual measured value (=156 N) which was obtained empirically substantially matches the calculated value (=158 N) which is based on equation 4, and it was possible to confirm that equation 4 was satisfied.

It can be understood from the verified results described above that the nip roller Gn may be disposed so as to satisfy the following expression in order to suppress the occurrence of slipping of the web 10 in relation to the drive roller Gd.

$$Th<\{Tl+f(1)\}\times\exp(\mu 0\times\theta 0) \quad \text{Expression 5}$$

Incidentally, in FIG. 3B, the nipped portion which is created by the nip roller Gn is aligned with the end of the one side (the low tension side) of the wound portion W0. However, as illustrated in FIG. 7, there is a case in which the nipped portion which is created by the nip roller Gn is positioned part way along the wound portion W0. Here, FIG. 7 is a diagram schematically illustrating the positional relationship between the drive roller and the nip roller, and illustrates a plan view as viewed from the axial direction of the drive roller. In FIG. 7, a virtual straight line which passes through the center of rotation Cn of the nip roller Gn and the center of rotation Cd of the drive roller Gd is illustrated as a straight line L(1), and an angle which is formed by the straight line L(1) and the straight line Lh along the wound portion W0 around the center of rotation Cd of the drive roller Gd is illustrated as an angle θ(1).

The following expression is arrived at when expanding the expression 5 to the configuration illustrated in FIG. 7.

$$Th<Tl\times\exp(\mu 0\times\theta 0)+f(1)\times\exp\{\mu 0\times 0(1)\} \quad \text{Expression 6}$$

In other words, more generally, the nip roller Gn may be disposed so as to satisfy expression 6. Therefore, in the web transporting apparatus A of the present embodiment, the nip rollers 24, 72, 47, and 53 are provided so as to satisfy expression 6 according to the tension difference between the upstream and downstream sides of the respective nipped portions.

In other words, the nip roller 24 is positioned at the boundary between the feed section 2 and the buffer section 3. Here, the tension of the web 10 at the feed section 2, which is on the upstream side in the transport direction Dc, is higher than the tension of the web 10 at the buffer section 3, which is on the downstream side in the transport direction Dc. Therefore, the nip roller 24 is disposed so as to satisfy expression 6, with the side which is upstream in the transport direction Dc of the nipped portion set to the high tension Th side, and the side which is downstream in the transport direction Dc of the nipped portion set to the low tension Tl side.

The nip roller 72 is positioned at the boundary between the buffer section 3 and the process section 4. Here, the tension of the web 10 at the process section 4, which is on the downstream side in the transport direction Dc, is higher than the tension of the web 10 at the buffer section 3, which is on the upstream side in the transport direction Dc. Therefore, the nip roller 72 is disposed so as to satisfy expression 6, with the side which is downstream in the transport direction Dc of the nipped portion set to the high tension Th side, and the side which is upstream in the transport direction Dc of the nipped portion set to the low tension Tl side.

The nip roller 47 is positioned at the boundary between the process section 4 and the carry-out section 5. Here, the tension of the web 10 at the process section 4, which is on the upstream side in the transport direction Dc, is higher than the tension of the web 10 at the carry-out section 5, which is on the downstream side in the transport direction Dc. Therefore, the nip roller 47 is disposed so as to satisfy expression 6, with the side which is upstream in the transport direction Dc of the nipped portion set to the high tension Th side, and the side which is downstream in the transport direction Dc of the nipped portion set to the low tension Tl side.

The drive roller 52 is positioned at the boundary between carry-out section 5 and the printer 1. Here, the tension of the web 10 at the outside of the printer 1, which is on the downstream side in the transport direction Dc, is higher than the tension of the web 10 at the carry-out section 5, which is on the upstream side in the transport direction Dc. Therefore, the nip roller 53 is disposed so as to satisfy expression 6, with the side which is downstream in the transport direction Dc of the nipped portion set to the high tension Th side, and the side which is upstream in the transport direction Dc of the nipped portion set to the low tension Tl side.

The nip rollers 24, 72, and 53 are disposed so as to satisfy the following expressions.

$$\theta 0-\theta(1)<\theta(1) \quad \text{Expression 7}$$

$$0<\theta 0-\theta(1) \quad \text{Expression 8}$$

In other words, the range (corresponding to the right side of expression 7) of the wound portion W0 at which each of the nip rollers 24, 72, and 53 nips the web 10 which is the high tension Th side of the nipped portion is provided to be wider than the range (corresponding to the left side of expression 7) which is the low tension Tl side of the nipped portion.

As described above, in the present embodiment which is configured in this manner, the web 10 which is wound around the drive roller Gd is nipped between the drive roller Gd and the nip roller Gn. The tension Tl is applied to the web 10 which is one side of the wound portion W0, and the tension Th which is greater than the tension Tl is applied to the web 10 which is the other side of the wound portion W0. In this configuration, there is a concern that the web 10 will slip from the low tension Tl side to the high tension Th side. To counteract the slipping, the present embodiment satisfies expression 6. Therefore, it is possible to secure the static friction force which acts against the difference between the tensions Th and Tl between the web 10 and the drive roller Gd, and it becomes possible to suppress the occurrence of slipping of the web 10.

Expressions 7 and 8 are satisfied with regard to the nip rollers 24, 72, and 53 of the present embodiment. In other words, using the nip roller Gn as a base point, the wound portion W0 has a wider range at the high tension Th side than the low tension Tl side. In this manner, by winding the web 10 around a wider range on the high tension Th side, it is possible to secure the static friction force which acts against the difference between the tensions Th and Tl between the web 10 and the drive roller Gd, and it becomes possible to suppress the occurrence of slipping of the web 10.

It is possible to firmly wind the web 10 around the drive roller Gd even with the tension Tl to secure the rigidity of the web 10 which passes between the drive roller Gd and the nip roller Gn by providing the wound portion W0 up to the low tension Tl side (that is, by satisfying expression 8). As a result, it becomes possible to further stabilize the transportation of the web 10.

Incidentally, in the embodiment described above, one of the nip rollers Gn is provided for one f the drive rollers Gd. However, the number of the nip rollers Gn which are provided in relation to one of the drive rollers Gd is not limited, and may be one or more, as illustrated in FIG. 8. Here, FIG. 8 is a diagram schematically illustrating the positional relationship between the drive roller and one or more of the nip rollers, and illustrates a plan view as viewed from the axial direction of the drive rollers. Here, a configuration is exemplified in which the plurality of nip rollers Gn are lined up in the circumferential direction of the drive roller Gd, and each of the nip rollers Gn nips the wound portion W0 of the web 10 between the drive roller Gd and the nip roller Gn.

In FIG. 8, where n is an integer of 1 or greater counting the nip rollers Gn along the wound portion W0 from the low tension Tl side, a virtual straight line which passes through the center of rotation Cn(n) of the nip roller Gn(n) and the center of rotation Cd of the drive roller Gd is illustrated as a straight line L(n), an angle which is formed by the straight line L(n) and the straight line Lh along the wound portion W0 around the center of rotation Cd of the drive roller Gd is illustrated as an angle θ(n), and a load which is applied to the drive roller Gd from the nth nip roller Gn(n) is illustrated as a load P(n). In the description of FIG. 8, the number of the nip rollers Gn which are provided in relation to the drive roller Gd is set to N (where N is an integer of 1 or greater), and the static friction coefficient between the drive roller Gd and the web 10 in the range (the nipped portion) which is pinched between the nth nip roller Gn and the drive roller Gd is set to a static friction coefficient μ(n). Expression 6 is generalized to the configuration illustrated in FIG. 8 to obtain the following expression.

[Math. 1]

$$Th < T1 \cdot \exp(\mu 0 \cdot \theta 0) + \sum_{n=1}^{N} f(n) \cdot \exp\{\mu 0 \cdot \theta(n)\} \tag{1}$$

$$f(n) = \mu(n) \cdot P(n)$$

Even in the embodiment illustrated in FIG. 8, by satisfying expression 1, it is possible to secure the static friction force which acts against the difference between the tensions Th and Tl between the web 10 and the drive roller Gd. As a result, it becomes possible to suppress the occurrence of slipping of the web 10. Incidentally, it is possible to transform expression 1 into expression 6 by incorporating N=1 into expression 1.

Even in the embodiment illustrated in FIG. 8, a configuration may be adopted which satisfies the following expression.

$$0<\theta 0-\theta(1)<\theta(1) \qquad \text{Expression 2}$$

When expression 2 is satisfied, the wound portion W0 has a wider range on the high tension Th side than the low tension Tl side, using the first nip roller Gn(1) as the base point, counting from the low tension Tl side. In this manner, by winding the web 10 around a wider range on the high tension Th side, it is possible to secure the static friction force which acts against the difference between the tensions Th and Tl between the web 10 and the drive roller Gd, and it becomes possible to suppress the occurrence of slipping of the web 10.

It is possible to firmly wind the web 10 around the drive roller Gd even with the tension Tl to secure the rigidity of the web 10 which passes between the drive roller Gd and the nip roller Gn by providing the wound portion W0 up to the low tension Tl side (that is, by satisfying expression 2). As a result, it becomes possible to further stabilize the transportation of the web 10.

In this manner, in the present embodiment, the printer 1 is equivalent to an example of an "image forming apparatus" of the invention, the web transporting apparatus A is equivalent to an example of a "web transporting apparatus" of the invention, the drive rollers 23, 71, 52, Gd, and the rotating drum 46 are equivalent to an example of a "drive roller" of the invention, the nip rollers 24, 72, 53, Gn, and 47 are equivalent to an example of a "driven roller" of the invention, the web 10 is equivalent to an example of a "web" of the invention, the wound portion W0 is equivalent to an example of a "wound portion" of the invention, and, in cooperation, the transport motors M21, M23, M71, M46, and M52 are equivalent to an example of a "tension application unit" of the invention.

Note that, the invention is not limited to the embodiment described above, and it is possible to add modifications to the configuration described above as long as the gist of the invention is not departed from. For example, in the printer 1 described above, each of the nip rollers 24, 72, 47, and 53 nips the web 10 by abutting the entire region of the web 10 in the axial direction. However, the web 10 which is subjected to image recording by the image recording section 8 in the process section 4 is in a state of being dampened by ink. Therefore, it is preferable to nip the web 10 except for the region thereof on which the image is recorded. Therefore, the nip roller 47 which nips the web 10 between the rotating drum 46 and the nip roller 47 on the downstream side in the transport direction Dc of the image recording section 8 may be configured as illustrated in FIGS. 9 and 10.

Here, FIG. 9 is a plan view schematically illustrating a modification example of the nip roller which nips the web between the rotating drum and the nip roller, and FIG. 10 is a side view schematically illustrating a modification example of the nip roller which nips the web between the rotating drum and the nip roller. FIGS. 9 and 10 illustrate the nip roller 47 and the periphery thereof. The web 10 is partially illustrated expanding in the transport direction Dc, and portions which are hidden by other members are illustrated with broken lines, as appropriate.

As illustrated in FIGS. 9 and 10, the nip roller 47 includes two cylindrical members 471 and one rotating shaft 472, and each of the cylindrical members 471 is supported by the rotating shaft 472 to be rotatable and the one rotating shaft 472 is provided parallel to the axial direction Da of the rotating drum 46. The two cylindrical members 471 are separated from each other in an axial direction Da of the rotating drum 46. The rotating shaft 472 is provided to be capable of moving in a direction approaching or separating from the rotating drum 46, and is biased to the rotating drum 46 side by the elastic members 48 which are provided on both ends of the rotating shaft 472. Therefore, the cylindrical members 471 which are supported by the rotating shaft 472 receive the force generated by the elastic members 48 to press the rotating drum 46 with a predetermined load (the nipping load). In this manner, the nip roller 47 nips the web 10 between the nip roller 47 and the rotating drum 46 using the cylindrical members 471.

At this time, one of the cylindrical members 471 nips an end portion Rr of one side of the web 10 in the axial direction Da between the rotating drum 46 and the cylindrical member 471, and the other cylindrical member 471 nips another end portion R1 of another side (the opposite of the first side) of the web 10 in the axial direction Da between the rotating drum 46 and the cylindrical member 471. In this manner, the two cylindrical members 471 are disposed on opposite sides from each other in relation to a center line which passes through the center of the web 10 in the axial direction Da.

Here, the end portions Rr and Rl are each aligned with a non-recording region of the web 10. In other words, as described above, the printer 1 records an image on the web 10 using the image recording section 8. At this time, the end portions Rr and Rl of a predetermined range from both end portions of the web 10 in the axial direction Da margins and are not subjected to the recording of images. The image is only recorded on a center portion Rm between the end portions Rr and Rl in the axial direction Da. The cylindrical members 471 have smaller widths than the corresponding end portions Rr and Rl in the axial direction Da, and are disposed to fit within the inside of the end portions Rr and Rl. In this manner, the cylindrical members 471 nip the web 10 in the non-recording regions which are provided at both ends of the web 10 in the axial direction Da. Note that, in the axial direction Da, the width of the rotating drum 46 is equal to or greater than the width of the web 10, and the web 10 fits within the inside of the rotating drum 46.

The cylindrical members 471 are capable of sliding in the axial direction Da in relation to the rotating shaft 472. Therefore, for example, due to a worker moving the cylindrical members 471 along the rotating shaft 472, it is possible to individually adjust the positions of the two cylindrical members 471 in the axial direction Da.

Even with regard to the nip roller 47 which is configured in this manner, it is possible to secure the static friction force which acts against the difference between the tensions Th and Tl between the web 10 and the rotating drum 46 at both ends of the wound portion W0 by satisfying expression 1 described above. As a result, it becomes possible to suppress the occurrence of slipping of the web 10. By satisfying expression 2, it is possible to wind the web 10 around a wider range on the high tension Th side to secure the static friction force which acts against the difference between the tensions Th and Tl between the web 10 and the rotating drum 46, and it becomes possible to suppress the occurrence of slipping of the web 10.

A case is conceivable in which the ink which lands on the web 10 in the image recording section 8 does not sufficiently dry by the time the ink reaches the space between the drive roller 52 and the nip roller 53. Therefore, the nip roller 53 which nips the web 10 between the drive roller 52 and the nip roller 53 on the downstream side in the transport direction Dc of the image recording section 8 may be configured in the same manner.

Here, FIG. 11 is a plan view schematically illustrating a modification example of the nip roller which nips the web between the drive roller and the nip roller, and FIG. 12 is a side view schematically illustrating a modification example of the nip roller which nips the web between the drive roller and the nip roller. FIGS. 11 and 12 illustrate the nip roller 53 and the periphery thereof. The web 10 is partially illustrated expanding in the transport direction Dc, and portions which are hidden by other members are illustrated with broken lines, as appropriate.

As illustrated in FIGS. 11 and 12, the nip roller 53 includes two cylindrical members 531 and one rotating shaft 532, and each of the cylindrical members 531 is supported by the rotating shaft 532 to be rotatable. The two cylindrical members 531 are separated from each other in the axial direction Da of the drive roller 52, and the one rotating shaft 532 is provided parallel to the axial direction Da of the drive roller 52. The rotating shaft 532 is provided to be capable of moving in a direction approaching or separating from the drive roller 52, and is biased to the drive roller 52 side by the elastic members 54 which are provided on both ends of the rotating shaft 532. Therefore, the cylindrical members 531 which are supported by the rotating shaft 532 receive the force generated by the elastic members 54 to press the drive roller 52 with a predetermined load (the nipping load). In this manner, the nip roller 53 nips the web 10 between the nip roller 53 and the drive roller 52 using the cylindrical members 531.

At this time, one of the cylindrical members 531 nips the end portion Rr of one side of the web 10 in the axial direction Da between the drive roller 52 and the cylindrical member 531, and the other cylindrical member 531 nips the other end portion Rl of the other side (the opposite of the first side) of the web 10 in the axial direction Da between the drive roller 52 and the cylindrical member 531. In this manner, the two cylindrical members 531 are disposed on opposite sides from each other in relation to a center line which passes through the center of the web 10 in the axial direction Da. In other words, in the same manner as in the case of the nip roller 47, the cylindrical members 531 have smaller widths than the corresponding end portions Rr and Rl in the axial direction Da, and are disposed to fit within the inside of the end portions Rr and Rl. In this manner, the cylindrical members 531 nip the web 10 in the non-recording regions which are provided at both ends of the web 10 in the axial direction Da. Note that, in the axial direction Da, the width of the drive roller 52 is equal to or greater than the width of the web 10, and the web 10 fits within the inside of the drive roller 52.

The cylindrical members 531 are capable of sliding in the axial direction Da in relation to the rotating shaft 532. Therefore, for example, due to a worker moving the cylindrical members 531 along the rotating shaft 532, it is possible to individually adjust the positions of the two cylindrical members 531 in the axial direction Da.

Even with regard to the nip roller 53 which is configured in this manner, it is possible to secure the static friction force which acts against the difference between the tensions Th and Tl between the web 10 and the drive roller 52 at both ends of the wound portion W0 by satisfying expression 1 described above. As a result, it becomes possible to suppress the occurrence of slipping of the web 10. By satisfying expression 2, it is possible to wind the web 10 around a wider range on the high tension Th side to secure the static friction force which acts against the difference between the tensions Th and Tl between the web 10 and the drive roller 52, and it becomes possible to suppress the occurrence of slipping of the web 10.

In the embodiment described above, description is given of a case in which the invention is applied to the printer 1 which records an image using an aqueous ink. However, it is acceptable to apply the invention to the printer 1 which records an image using another type of ink (for example, an ink which cures when irradiated with ultraviolet light, or the like).

It is possible to apply the invention to the printer 1 which transports the web 10 using so-called roll-to-roll. The member which supports the web 10 in relation to the recording head 81 is not limited to the drum shape described above, and it is acceptable for the member to be a flat plate shape.

The entire disclosure of Japanese Patent Application No. 2014-216242, filed Oct. 23, 2014 is expressly incorporated by reference herein.

REFERENCE SIGNS LIST

1 Printer
10 Web
23 Drive roller
24 Nip roller
71 Drive roller
72 Nip roller

46 Rotating drum
47 Nip roller
52 Drive roller
53 Nip roller
Gd, Gd(n) Drive roller
Gn, Gn(n) Nip roller
A Web transporting apparatus
Dc Transport direction

The invention claimed is:

1. A web transporting apparatus, comprising:

a drive roller which winds a web;

N (where N is an integer of 1 or greater) nip rollers which nip a wound portion, which is a portion of the web which is wound around the drive roller, between the drive roller and the nip rollers; and a tension application unit which applies a tension (Tl) to a portion of the web which is one side of the wound portion and applies a tension (Th) which is higher than the tension (Tl) to a portion of the web which is opposite the one side of the wound portion, wherein in front view as viewed from an axial direction of the drive roller, a straight line which passes through an end of the one side of the wound portion and a center of rotation of the drive roller is set to a straight line (Ll), a straight line which passes through an end of the other side of the wound portion and the center of rotation of the drive roller is set to a straight line (Lh), a straight line which passes through the center of rotation of the nth nip roller and the center of rotation of the drive roller is set to a straight line L(n), where n is an integer of 1 or greater counting the nip rollers along the wound portion from the one side, an angle which is formed by the straight line (Ll) and the straight line (Lh) along the wound portion around the center of rotation of the drive roller is set to an angle θ(0), an angle which is formed by the straight line L(n) and the straight line (Lh) along the wound portion around the center of rotation of the drive roller is set to an angle θ(n), a load which is applied to the drive roller from the nth nip roller is set to a load P(n), a static friction coefficient between the drive roller and the web in the wound portion is set μ(0), a static friction coefficient between the drive roller and the web in a range which is pinched between the nth nip roller and the drive roller is set to μ(n), and the nip rollers are provided so as to satisfy a following expression $$Th < T1 \cdot \exp\{\mu(0) \cdot \theta(0)\} + \sum_{n=1}^{N} f(n) \cdot \exp\{\mu(0) \cdot \theta(n)\}$$

$$f(n) = \mu(n) \cdot P(n).$$

2. The web transporting apparatus according to claim 1, wherein N=1, and wherein the nip rollers are provided so as to satisfy Th<Tl×exp {μ(0)×θ(0)}+f(1)×exp {μ(0)×θ(1)}.

3. The web transporting apparatus according to claim 2, wherein θ(0)>θ(1), and wherein the nip rollers are provided so as to satisfy θ(0)−θ(1)<θ(1).

4. The web transporting apparatus according to claim 2, wherein the end of the one side of the wound portion is positioned on the straight line L(1) and θ(0)=θ(1), and wherein the nip rollers are provided so as to satisfy Th<{Tl+f(1)}×exp {μ(0)×θ(0)}.

5. An image forming apparatus, comprising:

a web transporting apparatus which transports a web; and an image recording section which records an image on the web which is transported by the web transporting apparatus, wherein the web transporting apparatus includes a drive roller which winds the web;

N (where N is an integer of 1 or greater) nip rollers which nip a wound portion, which is a portion of the web which is wound around the drive roller, between the drive roller and the nip rollers; and a tension application unit which applies a tension (Tl) to a portion of the web which is one side of the wound portion and applies a tension (Th) which is higher than the tension (Tl) to a portion of the web which is opposite the one side of the wound portion, wherein in front view as viewed from an axial direction of the drive roller, a straight line which passes through an end of the one side of the wound portion and a center of rotation of the drive roller is set to a straight line (Ll), a straight line which passes through an end of the other side of the wound portion and the center of rotation of the drive roller is set to a straight line (Lh), a straight line which passes through the center of rotation of the nth nip roller and the center of rotation of the drive roller is set to a straight line L(n), where n is an integer of 1 or greater counting the nip rollers along the wound portion from the one side, an angle which is formed by the straight line (Ll) and the straight line (Lh) along the wound portion around the center of rotation of the drive roller is set to an angle θ(0), an angle which is formed by the straight line L(n) and the straight line along the wound portion around the center of rotation of the drive roller is set to an angle θ(n), a load which is applied to the drive roller from the nth nip roller is set to a load P(n), a static friction coefficient between the drive roller and the web in the wound portion is set to μ(0), a static friction coefficient between the drive roller and the web in a range which is pinched between the nth nip roller and the drive roller is set to μ(n), and the nip rollers are provided so as to satisfy a following expression $$Th < T1 \cdot \exp\{\mu(0) \cdot \theta(0)\} + \sum_{n=1}^{N} f(n) \cdot \exp\{\mu(0) \cdot \theta(n)\}$$

$$f(n) = \mu(n) \cdot P(n).$$

6. An image forming method, comprising:

winding a web around a drive roller, applying a tension (Tl) to a portion of the web which is one side of a wound portion, which is a portion of the web which is wound around the drive roller, and applies a tension (Th) which is higher than the tension (Tl) to a portion of the web which is opposite the one side of the wound portion; and recording an image on the web while transporting the web by rotating the drive roller in a state in which the wound portion is nipped between the drive roller and N (where N is an integer of 1 or greater) nip rollers, wherein in front view as viewed from an axial direction of the drive roller, a straight line which passes through an end of the one side of the wound portion and a center of rotation of the drive roller is set to a straight line (Ll), a straight line which passes through an end of the other side of the wound portion and the center of rotation of the drive roller is set to a straight line (Lh), a straight line which passes through the center of rotation of the nth nip roller and the center of rotation of the drive roller is set to a straight line L(n), where n is an integer of 1 or greater counting the nip rollers along the wound portion from the one side, an angle which is formed by the straight line (Ll) and the straight line (Lh) along the wound portion around the center of rotation of the drive roller is set to an angle θ(0), an angle which is formed by the straight line L(n) and the straight line (Lh) along the wound portion around the center of rotation of the drive roller is set to an angle θ(n), a load which is applied to the drive roller from the nth nip roller is set to a load P(n), a static friction coefficient between the drive roller and the web in the wound portion is set to μ(0), a static friction coefficient between the drive roller and the web in a range which is pinched between the nth nip roller and the drive roller is set to μ(n), and a following expression is satisfied $$Th < T1 \cdot \exp\{\mu(0) \cdot \theta(0)\} + \sum_{n=1}^{N} f(n) \cdot \exp\{\mu(0) \cdot \theta(n)\}$$

$$f(n) = \mu(n) \cdot P(n).$$

* * * * *